US008418613B2

(12) United States Patent
Mayor

(10) Patent No.: US 8,418,613 B2
(45) Date of Patent: Apr. 16, 2013

(54) METHODS OF ASSEMBLING, DISMANTLING AND TRANSFORMING A PRINT UNIT INTENDED FOR A PRINTING MACHINE, AND TRANSPORT DEVICE USED

(75) Inventor: Alain Mayor, Preverenges (CH)

(73) Assignee: Bobst SA, Lausanne (CH)

( * ) Notice: Subject to any disclaimer, the term of this patent is extended or adjusted under 35 U.S.C. 154(b) by 700 days.

(21) Appl. No.: 12/598,242

(22) PCT Filed: Apr. 8, 2008

(86) PCT No.: PCT/EP2008/002768

§ 371 (c)(1),
(2), (4) Date: Oct. 30, 2009

(87) PCT Pub. No.: WO2008/141699

PCT Pub. Date: Nov. 27, 2008

(65) Prior Publication Data

US 2010/0132575 A1 Jun. 3, 2010

(30) Foreign Application Priority Data

May 2, 2007 (EP) ..... 07008833

(51) Int. Cl.
*B41F 33/00* (2006.01)

(52) U.S. Cl.
USPC ..... 101/483; 101/479

(58) Field of Classification Search ..... 101/483, 101/479, 486, 485
See application file for complete search history.

(56) References Cited

U.S. PATENT DOCUMENTS 3,625,145 A 12/1971 Heatley et al.
4,137,843 A * 2/1979 Ottenhue ..... 101/153
5,060,569 A * 10/1991 Gladow ..... 101/216
5,069,125 A 12/1991 Schiavi
5,142,978 A * 9/1992 Borel ..... 101/177
5,178,678 A * 1/1993 Koehler et al. ..... 118/46
5,388,515 A * 2/1995 Schneider et al. ..... 101/363
5,588,361 A * 12/1996 Riis ..... 101/216
5,715,749 A * 2/1998 Miller ..... 101/216
7,273,007 B2 * 9/2007 DeMoore et al. ..... 101/216
7,690,909 B2 * 4/2010 Wahlstrom ..... 425/375

FOREIGN PATENT DOCUMENTS

CH 263 299 A 8/1949
EP 0 682 601 11/1995

(Continued)

OTHER PUBLICATIONS

International Search Report dated Jun. 18, 2008, issued in corresponding international application No. PCT/EP2008/002768.

*Primary Examiner* — Anthony Nguyen
(74) *Attorney, Agent, or Firm* — Ostrolenk Faber LLP

(57) ABSTRACT

A method of assembling (R, V) a print unit (1, 2) belonging to a printing machine, the print unit (1, 2) comprising a frame (9), a print carriage (7), able to be inserted into and attached to the frame (9), and a doctor blade system (14), independent of the print carriage (7) and able to be attached to said frame (9), comprises the steps consisting in:

placing the doctor blade system (14) on an empty transport device (16), inserting said transport device with said doctor blade system (14) into said frame (9), attaching said doctor blade system (14) to said frame (9), removing said empty transport device (16) from said frame (9), inserting said print carriage (7) into said frame (9), and attaching said print carriage (7) to said frame (9).

9 Claims, 4 Drawing Sheets

FOREIGN PATENT DOCUMENTS

| | | |
|---|---|---|
| FR | 1 051 005 A | 1/1954 |
| FR | 2 563 469 | 10/1985 |
| FR | 2 637 222 A1 | 4/1990 |
| WO | WO 94/18007 | 8/1994 |

* cited by examiner

METHODS OF ASSEMBLING, DISMANTLING AND TRANSFORMING A PRINT UNIT INTENDED FOR A PRINTING MACHINE, AND TRANSPORT DEVICE USED

CROSS REFERENCE TO RELATED APPLICATION

The present application is a 35 U.S.C. §§371 national phase conversion of PCT/EP2008/002768, filed Apr. 8, 2008, which claims priority of European Application No. 07008833.1, filed May 2, 2007, incorporated by reference herein. The PCT International Application was published in the French language.

BACKGROUND OF THE INVENTION

The present invention relates to a method of assembling a print unit for a printing machine, a method of dismantling a print unit for a printing machine, a method of transforming a print unit for a printing machine, a transport device that can be used in a method of assembling, dismantling and/or transforming a print unit, intended for a printing machine and to a device designed to be used by being inserted into a print unit intended for a printing machine. The print unit is more specifically used in a photogravure printing machine.

Photogravure is a rotary printing method that can be used for numerous media, including paper or cardboard, using engraved cylinders. Photogravure printing is particularly employed for high quality and mass circulation publications in which the graphics have to play an important role in the promotion of a product, such as packaging in the form of a cardboard box. This printing method makes it possible to print up to twelve colors or more in a single print run using solvent-based inks.

Thus, in a photogravure printing machine, a medium to be printed in the form of a continuous strip passes through a succession of photogravure print units. The print units are assembled and arranged longitudinally one after the other along a path from the entry of the medium to be printed upstream to its exit downstream. Each print unit prints a pattern with a single specific color or a particular varnish, or even performs an embossing step.

Increasingly more users want a printing machine that offers wide flexibility of use. First, they want to be able to make extremely rapid work changes by modifying the engraved printing cylinders, in order to meet their customers' increasingly customized demands for short print runs. Then, a need emerged in terms of additional visual effects to be reproduced on the medium, such as gilding and silvering, matt, shiny or structured varnishes, recto, verso, embossings and other visual effects, also requiring new printing techniques. However, because of the length of the printing machines and because of the very high costs, users can rarely add additional print units in the middle of a printing machine.

PRIOR ART

To facilitate the desired adaptability of the print units, U.S. Pat. No. 3,625,145 describes a removable print carriage intended for use in photogravure printing, in order to facilitate handling and swapping of the engraved cylinders. The carriage comprises a frame, means cooperating with the support means of the print unit, and an engraved printing cylinder rotatable relative to the carriage. This carriage is inserted into a space situated inside a print unit, which incorporates support means for receiving the carriage. The printing cylinder is locked to a drive mechanism.

However, such a carriage is used specifically only for engraved cylinders. Furthermore, the doctor blade system remains permanently mounted on the carriage and cannot easily be removed.

FR 2 563 469 discloses a photogravure print unit provided with two doctor blade systems arranged longitudinally on two opposite sides, relative to the cylinder, so as to allow recto printing or verso printing as required. A carriage is used to facilitate the introduction and extraction of the cylinder into and from the print unit, in a longitudinal direction relative to the print unit. One of the doctor blade systems is linked to a structural part of the print unit. The structural part slides vertically along slide rails between a bottom position, in which the doctor blade system is in the position of use, and a top position in which this doctor blade system is at a greater height above the cylinder.

However, such a print unit demands the permanent presence of two doctor blade systems, one of the two remaining unused while the other is in operation. A supernumerary doctor blade system makes the print unit expensive. Furthermore, there is no provision for removing the doctor blade system or systems, for interventions on the print unit or for other modifications of this same print unit.

EP 0 682 601 discloses a carriage that is designed for use in different types of printing machines. This carriage supports one or more removable parts, which makes it possible to insert them and remove them into and from the print unit of the printing machine. A doctor blade system, in this case in the form of a doctor blade chamber, is part of the removable parts. The carriage is positioned longitudinally relative to the print unit. The carriage comprises a mobile frame for adding or removing the removable part or parts. Transfer means and fixing means for the removable part or parts inside the print unit are also provided.

However, such a carriage remains specifically dedicated to this print unit, for which the introduction of the removable parts must imperatively be done longitudinally and in just one direction. There is no provision for positioning the doctor blade system for verso printing. Furthermore, the aim of the carriage is only to facilitate the introduction and removal of the removable parts for cleaning and repair operations. The internal coupling elements for the removable parts remain permanently fixed to the print unit.

DESCRIPTION OF THE INVENTION

One main problem that the present invention proposes to resolve consists in implementing a method of assembling, dismantling and/or transforming a print unit. A second problem is how to carry out a method of assembling a print unit, using a transport device. A third problem is how to obtain a method of dismantling and transforming a print unit, in order to change its destination, with a transport device. A fourth problem is how to perfect a transport device designed to be used by being inserted into a frame in a print unit. Yet another problem is how to position a doctor blade system on a transport device and transfer it from this same device to the print unit. One aim of the invention is to resolve the technical problems mentioned for the documents of the state of the art.

In accordance with one aspect, the present invention targets a method of assembling a print unit belonging to a printing machine. The print unit comprises a frame, a print carriage, capable of being inserted into and attached to the frame, and a doctor blade system, independent of the print carriage and able to be attached to this frame.

The assembly method comprises the steps of:

placing the doctor blade system on an empty transport device, inserting this transport device with this doctor blade system into this frame, attaching this doctor blade system to this frame, removing this empty transport device from this frame, inserting this print carriage into this frame, and attaching this print carriage to this frame.

In other words, by providing a transport device that is specific to the doctor blade system, the latter can easily be moved, to allow the operator to assemble the print unit according to his requirements. The transport device is defined as an assembly that can be moved, that can support the weight of the doctor blade system, and that is provided or is not provided with wheels, of transport carriage or other type. The transport device is dimensioned appropriately for its insertion into and its removal from the frame of the print unit, by being maneuverable by an operator.

According to another aspect, the present invention targets a method of dismantling and/or transforming a print unit belonging to a printing machine. The print unit comprises a frame, a print carriage, inserted into and attached to the frame, and a doctor blade system, independent of the print carriage and attached to this frame.

The dismantling and/or transformation method comprises the steps:

detaching this print carriage from this frame, removing this print carriage from this frame, inserting an empty transport device into this frame, detaching the doctor blade system from this frame, placing this doctor blade system on the empty transport device, and removing this transport device with this doctor blade system from this frame.

In other words, with the removable doctor blade system, access by the operator to the other members of the print unit is facilitated. By removing the doctor blade system, the operator frees space inside the print unit, which makes it possible to more easily modify this same print unit. Furthermore, with the transport device and the print carriage, it remains very easy for the operator to make any modification to the print unit.

The invention also relates to a transport device, suitable for transporting a doctor blade system, for inserting the system into and removing it from a frame of a print unit belonging to a printing machine. That device comprises a frame and a support element, and it offers a capacity for insertion and removal transversely relative to the frame, and in that the support element offers a capacity to be mobile in a substantially longitudinal direction, to assume two extreme positions in upstream and downstream directions, so as to enable the doctor blade system to be attached or detached and transported.

Throughout the description, the longitudinal direction is defined as being the horizontal direction of progress of the medium to be printed throughout the printing machine. The upstream direction is defined as being the horizontal direction from which the blank medium to be printed enters into the print unit or into the printing machine. The downstream direction is defined as being the horizontal direction toward which the graphically printed medium exits from the print unit or from the printing machine. The transversal direction is defined as being the horizontal direction perpendicular to the direction of progress of the medium to be printed.

In other words, the device allows not only the entry, exit and transportation of the doctor blade system, but also a reverse positioning of the doctor blade system inside the print unit. The downstream position allows printing on the recto side and the upstream position allows printing on the verso side.

BRIEF DESCRIPTION OF THE DRAWINGS

The invention will be clearly understood and its various benefits and different characteristics will become more apparent from the following description, of the nonlimiting exemplary embodiment, with reference to the appended diagrammatic drawings in which.

DETAILED EXPLANATION OF PREFERRED EMBODIMENTS

Figure 1:
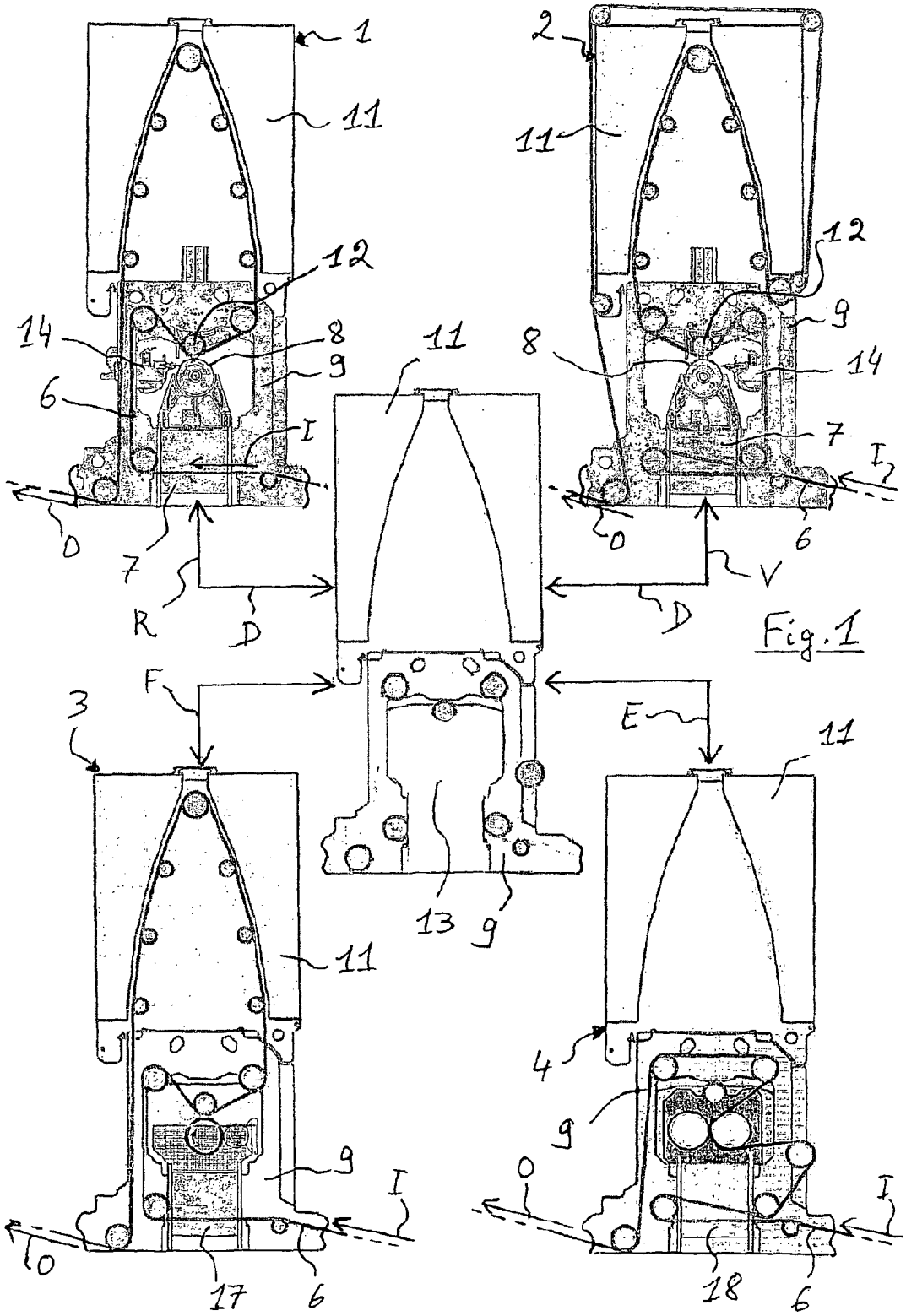
FIG. 1 represents a synoptic view of the various methods according to the invention.
Figure 2:
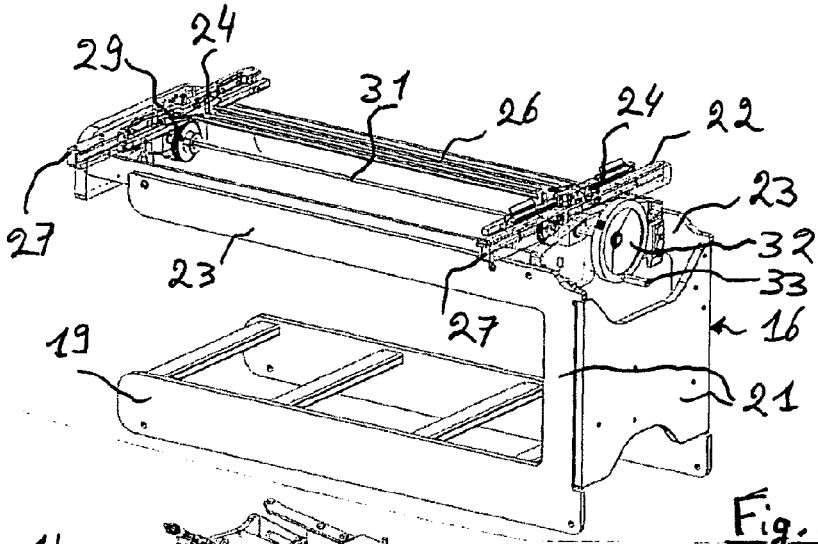
FIG. 2 represents a perspective view of a transport device according to the invention.
Figure 3:
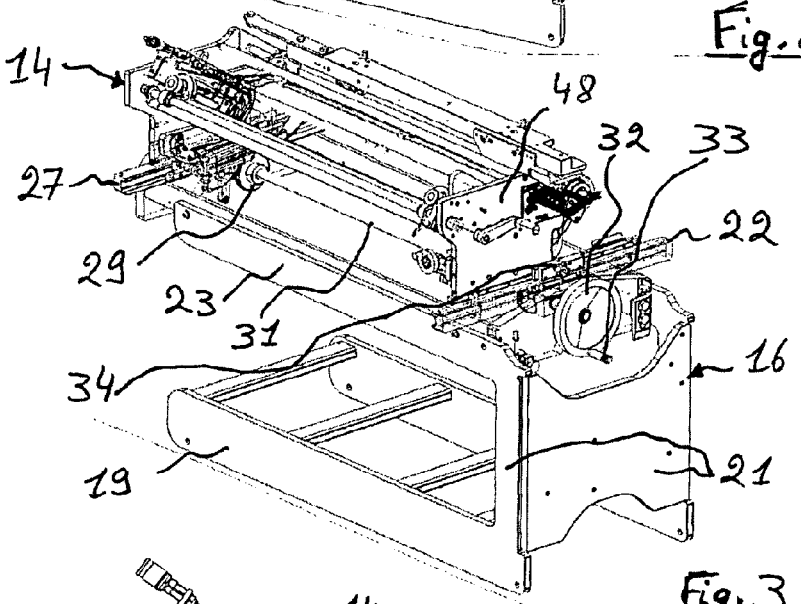
FIG. 3 represents a perspective view of a transport device with a doctor blade system.

As FIG. 1 illustrates, a printing machine comprises a plurality of print units (1, 2, 3 and 4) that are mounted in succession one after the other in order to form a printing machine. A print medium (6) enters upstream (arrow I in FIG. 1) in each of the print units (1, 2, 3 and 4), for example to be printed with a color, and leaves them downstream (arrow O). The print medium (6) enters (I) and leaves (O) as many print units (1, 2, 3 and 4) as necessary, to produce the different color prints or the necessary effects.

Each print unit (1, 2, 3 and 4) comprises a print carriage (7), itself having an engraved cylinder (8), an ink inlet that brings the ink to the engraved cylinder (8), and an ink fountain, which recovers the ink overflow. Each print unit (1, 2, 3 and 4) also has a frame (9), a drier (11) which rapidly evaporates solvents or water, or even polymerizes ink by UV, a pressure roller (12), which strongly presses the print medium (6) onto the cylinder (8), and a pump that feeds ink from the tank to the ink applicator (not shown in FIG. 1). The print carriage (7) is inserted into an empty space (13) provided in the center of the frame (9), by being inserted transversely, that is to say, perpendicularly to the direction of progress of the medium (6).

A doctor blade system (14) eliminates the surplus ink on the cylinder (8) by means of a scraping blade, shaving the peripheral surface of the cylinder (8) and leaving only the ink that has penetrated into the cells. The doctor blade system (14) is fixed to the frame (9). The doctor blade system (14) projects into the space (13) of the frame (9).

The first print unit (1) performs a recto print and the second print unit (2) performs a verso print on the print medium (6), which requires a reverse positioning of the doctor blade system (14), downstream or upstream relative to the direction of advance (I and O) of the print medium (6), and a different routing mechanism for the print medium (6) inside the frame (9).

Figure 4:
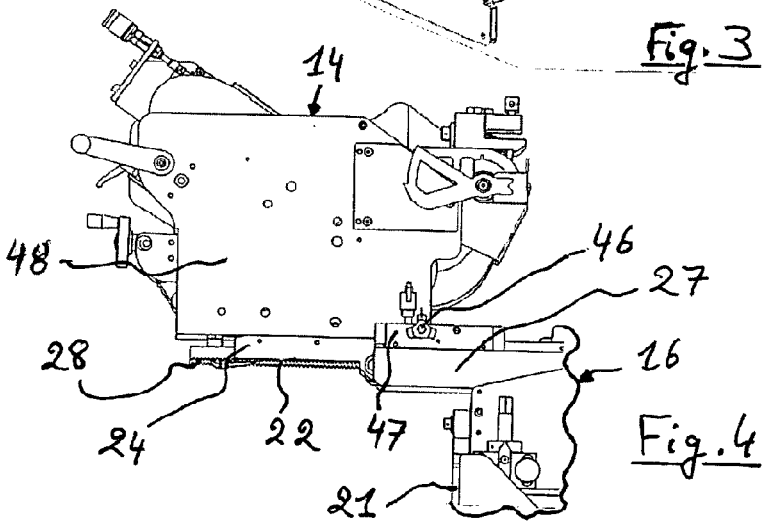
FIG. 4 represents a partial side view of the transport device with the doctor blade system.

As represented by FIG. 1, to change from an empty frame (9) for example to a recto print unit (1) or to a verso print unit (2), and according to the invention, a method of assembling a print unit comprises a plurality of steps. A first step comprises placing the doctor blade system (14) on a transport device or empty transport carriage (16), outside the frame (9) (FIG. 4). A second step comprises inserting the transport carriage (16) with the doctor blade system (14) into the frame (9) of the print unit (1 and 2).

Preferably, the step of inserting the transport carriage (16) can be carried out transversely relative to the frame (9). The method may include an additional step, arranged after the step of inserting the transport carriage (16) with the doctor blade system (14). This added step favorably comprises centering and locking this transport carriage (16), relative to this frame (9) of the print unit (1 and 2).

The assembly method may include an additional step arranged after the step of placing the doctor blade system (14) on the empty transport carriage (16), before the step of inserting this transport carriage (16). Advantageously, this added step can comprise locking the doctor blade system (14) onto this empty transport carriage (16).

A third step comprises attaching the doctor blade system (14) to the frame (9). In a first embodiment of the third step (arrow R in FIG. 1), the attachment of the doctor blade system (14) is done on the downstream side, to obtain a recto print unit (1). In a second embodiment of the third step (arrow V in FIG. 1), the attachment of the doctor blade system (14) is done on the upstream side, to obtain a verso print unit (2). A fourth step comprises removing the empty transport carriage (16) from the frame (9), outside the print unit (1 or 2). A fifth step comprises inserting the print carriage (7) into the frame (9).

The method can include an additional step, arranged after the step of inserting the print carriage (7). This added step can favorably comprise centering and locking this print carriage (7), relative to this frame (9) of the print unit (1 and 2). Very preferably, the step comprises inserting the print carriage (7) transversely relative to the frame (9). A sixth step comprises attaching the print carriage (7) to the frame (9).

As represented by FIG. 1, to change from a print unit (1 or 2) to an empty frame (9), suitable for use in different variant embodiments, and according to the invention, a method of dismantling (arrows D in FIG. 1) and transforming a print unit (1 and 2) comprises a plurality of steps. A first step comprises detaching the print carriage (7) from the frame (9). A second step comprises removing the print carriage (7) from the frame (9), outside the print unit (1 and 2). Very preferably, the step comprises removing the print carriage transversely relative to the frame (9).

A third step comprises inserting an empty transport carriage (16) into the frame (9). A fourth step comprises detaching the doctor blade system (14) from the frame (9). A fifth step comprises placing the doctor blade system (14) on the empty transport carriage (16). A sixth step comprises removing the transport carriage (16) with the doctor blade system (14) from the frame (9) outside the print unit (1 and 2). Very preferably, the step comprises removing this transport carriage (16) done transversely relative to the frame (9).

The dismantling method can include an additional step, arranged after the step comprising placing the doctor blade system (14) on the empty transport carriage (16), and before the step of removing this transport carriage (16) with this doctor blade system (14). Advantageously, this added step can comprise locking the doctor blade system (14) to this empty transport carriage (16).

The method of transforming the print unit (1) can include two additional steps, arranged after the step comprising removing the transport carriage (16) with the doctor blade system (14). In a first variant embodiment of this method, these added steps can comprise inserting this transport carriage (16) with a doctor blade system (14) in the reverse position in the frame (9), and then attaching the doctor blade system (14) in the reverse position to this frame (9) of the print unit (2). The recto print unit (1) is transformed into a verso print unit (2). The method can include an additional step, arranged after the step comprising inserting the transport carriage (16) with a doctor blade system (14) in the reverse position. This added step can favorably comprise centering and locking this transport carriage (16), relative to this frame (9) of the print unit (1 or 2).

In a second variant embodiment of this method, the method of transforming the print unit (1 and 2) can include two additional steps, arranged after the step of removing the transport carriage (16) with the doctor blade system (14). These added steps may comprise inserting (arrow F in FIG. 1) a flexographic print carriage (17) into the frame (9) and then attaching the flexographic print carriage (17) to the frame (9) of the print unit (3).

Preferably, the step of inserting a flexographic print carriage (17), can be done transversely relative to the frame (9). The method may include an additional step, arranged after the step of inserting a flexographic print carriage (17). This added step may favorably comprise centering and locking the flexographic print carriage (17), relative to this frame (9) of the print unit (3).

In a third variant embodiment, the method of transforming the print unit (1 and 2) may include two additional steps, arranged after the step of removing the transport carriage (16) with the doctor blade system (14). These added steps may comprise inserting (arrow E in FIG. 1) an embossing carriage (18) into the frame (9) and then attaching the embossing carriage (18) to the frame (9) of the print unit (4).

Preferably, the step of inserting an embossing carriage (18) can be done transversely relative to the frame (9). The method may include an additional step, arranged after the step of inserting an embossing carriage (18) into the frame (9). This added step may favorably comprise centering and locking the embossing carriage (18), relative to this frame (9) of the print unit (4).

The transport device or carriage (16) according to the invention comprises a frame, similar to a table, in the form of a transverse bottom underframe (19), a vertical upright (21), and a support element (22). The support element (22) is mounted on two transverse top beams (23), starting from the vertical upright (21) and cantilevered relative to the underframe (19). The transport carriage (16) is easily moved by an operator using a small removable carriage with low wheels, of hand truck type.

According to the invention, the transport carriage (16) is dimensioned to penetrate into and emerge transversely from the empty space (13) of the frame (9) of the print unit (1, 2, 3 and 4). The doctor blade system (14) is placed on the support element (22), so as to allow it to be transported.

According to the invention, the support element (22) is mobile in a substantially longitudinal direction, to assume two extreme positions in the upstream and downstream directions relative to the direction of progress of the print medium (6), so as to allow the doctor blade system (14) to be attached or detached.

Figure 5:
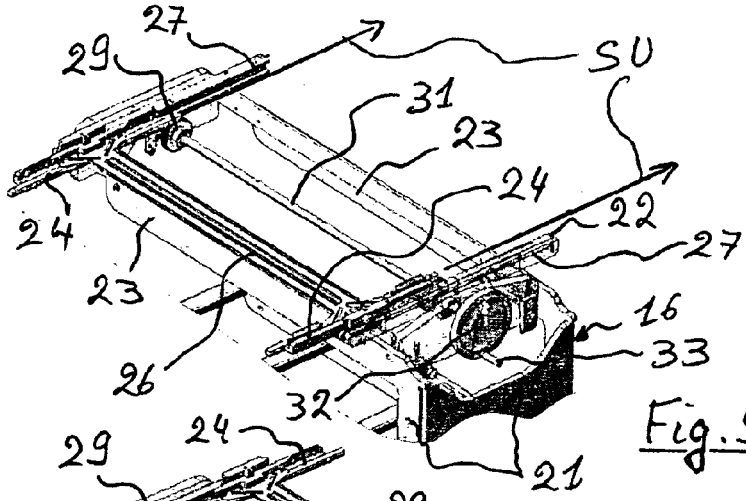
FIGS. 5 and 6 respectively represent partial perspective views showing the two extreme positions taken by an element supporting the transport device.
Figure 6:
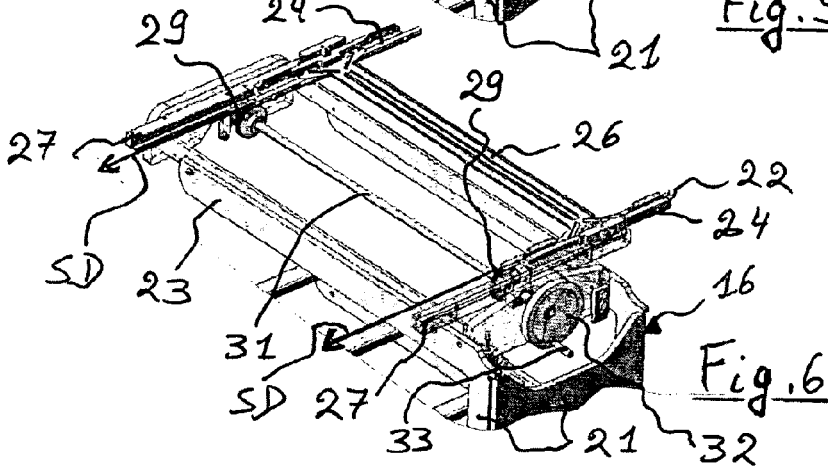

When the support element (22) is in the extreme position in the downstream direction (see FIG. 5), the doctor blade system (14) is attached to the print unit (1) for the latter to do a recto print. When the support element (22) is in the extreme position in the upstream direction (see FIG. 6), the doctor blade system (14) is attached to the print unit (2) for the latter to do a verso print.

To enable the doctor blade system (14) to be moved to or from the two extreme positions, the support element (22) comprises two longitudinal bars (24) linked by a transverse spacer (26). The doctor blade system (14) rests on the two longitudinal bars (24). The two longitudinal bars (24) can move by sliding in two longitudinal rails (27), attached to the two top beams (23). The sliding is done in the upstream direction (arrows SU in FIG. 5) and in the downstream direction (arrows SD in FIG. 6).

The sliding is achieved by gear-meshing two longitudinal racks (28), fixed to the two longitudinal bars (24), with two longitudinal pinions (29). The two pinions (29) are interlinked by a control rod (31) and driven by a handwheel (32) and a handle (33).

When the operator rotates the handwheel (32), the control rod (31) and the pinions (29) rotate, which drives the movement of the rack (28) and of the two longitudinal bars (24). The operator then either fetches the doctor blade system (14) to dismantle and transform the print unit (1 and 2), or places the doctor blade system (14) in the recto or verso position to assemble the print unit (1 and 2).

Figure 7:
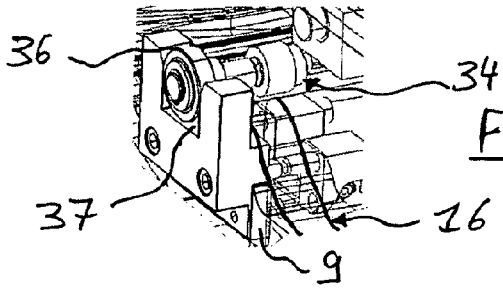
FIG. 7 represents a partial perspective view of the rear centering means of the transport device relative to the print unit.

As can be seen in FIG. 7, the transport carriage (16) may comprise centering means, able to cooperate with corresponding, conjugate centering means present in the frame of the print unit. These centering means comprise (see FIG. 7) rear centering means (34), situated at the distal transverse end of the transport carriage (16), that is, opposite the handwheel (32) and not accessible to the operator when the transport carriage (16) is inserted into the print unit (1 and 2). The rear centering means (34) take the form of a cam roller (36), engaging in a corresponding rear groove (37) that is part of the frame (9) of the print unit (1 and 2).

Figure 8:
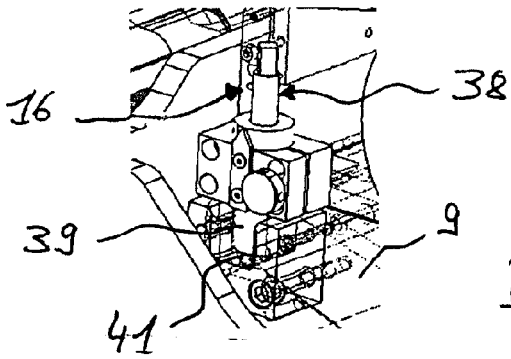
FIG. 8 represents a partial perspective view of the front centering means of the transport device relative to the print unit.

These centering means comprise (see FIG. 8) front centering means (38) situated at the proximal transverse end of the transport carriage (16), that is to say, at the handwheel end (32) and accessible to the operator when the transport carriage (16) is inserted into the print unit (1 and 2). The front centering means (38) take the form of a pin (39), engaging in a corresponding front groove (41), forming part of the frame (9) of the print unit (1 and 2). It should be noted that the rear groove (37) and the front groove (41) of the frame (9) can also be used for the "skewing" adjustment which is an adjustment technique based on offsetting the engraved cylinder of the print carriage (7).

Figure 9:
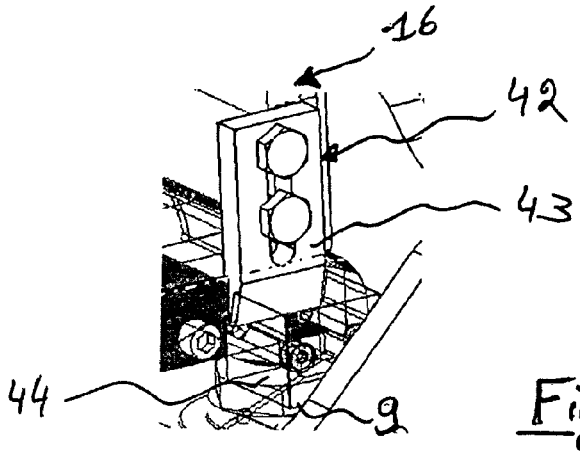
FIG. 9 represents a partial perspective view of the means of locking the transport device to the print unit.

As represented in FIG. 9, the transport carriage (16) may include locking means (42), able to cooperate with corresponding, conjugate locking means present in the frame (9) of the print unit (1 and 2). These locking means (42) comprise a bolt (43) situated at the proximal transverse end of the transport carriage (16). The bolt (43) is inserted into and immobilized against a block (44) of the frame (9). It should be noted that the block (44) of the frame (9) may also be used to lock the print carriage (7).

Figure 10:
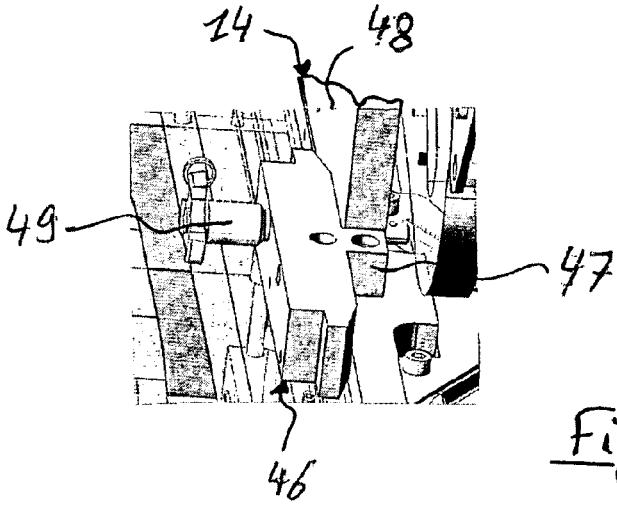
FIG. 10 represents a partial perspective view of the means of locking the doctor blade system to the transport device.

As FIG. 10 shows, the transport carriage (16) may include locking means (46), able to cooperate with corresponding, conjugate locking means present on the doctor blade system (14). These locking means (46) are part of the two longitudinal bars (24). The locking means comprise two studs provided with an abutment (47), each provided on the two longitudinal bars (24), and against which the respective edge of the longitudinal plates (48) of the doctor blade system (14) are pressed. These locking means (47) also include two pins (49), respectively being inserted both into an orifice provided in the stud (47) and into the longitudinal plates (48) of the doctor blade system (14).

The present invention is not limited to the embodiments described and illustrated. Numerous modifications can be made, without in any way departing from the framework defined by the scope of the set of claims.

The invention claimed is:

1. A method of assembling a print unit of a printing machine, wherein the print unit comprises a frame, an empty volume being provided in the center of the frame, a print carriage having a printing cylinder and configured to be inserted into and to be attached to said frame, and a doctor blade system, independent of said print carriage and configured to be attached to said frame, the method comprising the steps of:

placing said doctor blade system on an empty transport device, inserting said transport device with said doctor blade system transversely relative to said frame and into said empty volume of said frame, attaching said doctor blade system to said frame, removing said empty transport device transversely relative to said frame and from said empty volume of said frame while said doctor blade system remains in and attached to said frame, inserting said print carriage transversely relative to said frame and into said empty volume of said frame, and attaching said print carriage to said frame.

2. A method of dismantling or transforming a print unit from a printing machine, wherein the print unit comprises a frame, an empty volume being provided in the center of the frame, a print carriage having a printing cylinder and inserted into and attached to said frame, and a doctor blade system independent of said print carriage and attached to said frame, the method comprising the steps in sequence of:

detaching said print carriage from said frame, removing said detached print carriage transversely relative to said frame and from said empty volume of said frame, inserting an empty transport device transversely relative to said frame and into said empty volume of said frame, detaching said doctor blade system from said frame, placing said doctor blade system on said empty transport device, and removing said transport device with said doctor blade system transversely relative to said frame and from said empty volume of said frame.

3. The method according to claim 1, further comprising an additional step, after said placing of said doctor blade system on said empty transport device and before said inserting said transport device with said doctor blade system, said additional step comprising locking said doctor blade system onto said transport device.

4. The method according to claim 2, further comprising two additional steps, after said removing of said transport device with said doctor blade system, said additional steps comprising inserting said transport device with said doctor blade system in a reverse position inside said frame, and then attaching said doctor blade system in said reverse position to said frame.

5. The method according to claim 2, further comprising two additional steps, after said step of removing said transport device with said doctor blade system, said additional steps comprising inserting a flexography print carriage into said frame, and then attaching said flexography print carriage to said frame.

6. The method according to claim 2, further comprising two additional steps, after said step of removing said transport device with said doctor blade system, said additional steps comprising inserting an embossing carriage into said frame, and then attaching said embossing carriage to said frame.

7. The method according to claim 1, further comprising, after said step of inserting said transport device with said doctor blade system, or after said step of inserting said print carriage, a step of centering and locking said transport device or said print carriage, relative to said frame.

8. The method according to claim 2, further comprising an additional step, before said removing of said transport device with said doctor blade system, said additional step comprising locking said doctor blade system onto said empty transport device.

9. The method according to claim 2, further comprising, after said step of inserting said empty transport device, a step of centering and locking said empty transport device relative to said frame.

* * * * *

UNITED STATES PATENT AND TRADEMARK OFFICE

CERTIFICATE OF CORRECTION

PATENT NO. : 8,418,613 B2
APPLICATION NO. : 12/598242
DATED : April 16, 2013
INVENTOR(S) : Alain Mayor It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 700 days.

Signed and Sealed this
First Day of September, 2015

Michelle K. Lee

Michelle K. Lee
*Director of the United States Patent and Trademark Office*